US008715834B2

(12) United States Patent
Hochleutner et al.

(10) Patent No.: US 8,715,834 B2
(45) Date of Patent: May 6, 2014

(54) CONTINUOUS STEEL STRAPPING SEALS

(75) Inventors: Jeffrey P. Hochleutner, Elmhurst, IL (US); Michael J. Gilman, Arlington Heights, IL (US); Kenneth Hoffman, Deerfield, IL (US); Janusz Figiel, Mundelein, IL (US)

(73) Assignee: Illinois Tool Works Inc., Glenview, IL (US)

( * ) Notice: Subject to any disclaimer, the term of this patent is extended or adjusted under 35 U.S.C. 154(b) by 212 days.

(21) Appl. No.: 13/205,093

(22) Filed: Aug. 8, 2011

(65) Prior Publication Data

US 2012/0295126 A1 Nov. 22, 2012

Related U.S. Application Data

(60) Provisional application No. 61/378,198, filed on Aug. 30, 2010.

(51) Int. Cl.
*B65D 63/06* (2006.01)

(52) U.S. Cl.
USPC ..... 428/596; 428/43; 428/136; 24/23 W

(58) Field of Classification Search
USPC ..... 428/43, 596, 136; 24/23 W; 206/820
See application file for complete search history.

(56) References Cited

U.S. PATENT DOCUMENTS

| | | | | | |
|---|---|---|---|---|---|
| 1,444,103 | A | * | 2/1923 | Boyd | 24/23 W |
| 2,881,915 | A | | 12/1959 | Palmleaf et al. | |
| 3,089,233 | A | | 5/1963 | Meier | |
| 3,164,250 | A | | 1/1965 | Paxton | |
| 3,177,915 | A | * | 4/1965 | La Fleur et al. | 411/181 |
| 3,237,256 | A | | 3/1966 | Young | |
| 4,044,888 | A | * | 8/1977 | Schachter | 206/717 |
| 2009/0241298 | A1 | | 10/2009 | Figiel | |

FOREIGN PATENT DOCUMENTS

DE 1215577 B 4/1966

* cited by examiner

*Primary Examiner* — Alexander Thomas
(74) *Attorney, Agent, or Firm* — Levenfeld Pearlstein, LLC

(57) ABSTRACT

A strip of multiple seals, each seal for sealing around overlying courses of strapping material to form a seal of the strapping material onto itself at the overlying courses includes an elongated strip of ductile metal. The strip has a longitudinal direction having edges and defining a longitudinal axis parallel to the edges, and a transverse direction normal to the longitudinal axis. Each seal defines a respective transverse axis. The strip has a plurality of substantially identical slots formed in the transverse direction to define the respective seals. The slots extend toward, but not to, the edges of the strip and define connecting portions between ends of the slot and the respective edges. The slots are equally spaced from one another in a longitudinal direction to define the respective seals.

11 Claims, 3 Drawing Sheets

CONTINUOUS STEEL STRAPPING SEALS

CROSS-REFERENCE TO RELATED APPLICATION DATA

This application claims the benefit of U.S. Provisional Patent application Ser. No. 61/378,198, filed Aug. 30, 2010.

BACKGROUND

In an effort to ensure the stability of cargo and large bundles, during both intermediary and extended transport, a ligature or wrapping of some sort, such as steel or plastic strapping, is routinely placed around the load. Contained within a secure wrapping, such as steel or plastic strapping, the load is more likely to remain in position during transport to a desired location. Typically, to facilitate the transport and lifting of large bundles, the strapping is made of fabric, wire, metal or plastic and secured by metal seals. These seals join the opposing overlapping ends of the strapping together, and become crimped or flattened or cut to form joints in the seal that are used to secure and prevent movement of the load.

The seals are formed as individual elements. The seals can be provided, for example in a powered strapping machine, in a magazine, in which the seals are loaded. The individual seals are fed on an as needed basis from the magazine. The seals are maintained in a stack in the magazine and are used until the magazine is depleted of seals. When the magazine is depleted, a new stack of seals is placed in the magazine and the strapping operation is restarted or commenced. Exemplary seals are disclosed in Meier, U.S. Pat. No. 3,089,233 and Young, U.S. Pat. No. 3,237,256, both of which patents are incorporated herein by reference.

While this type of seal and system of supply functions well, it will be recognized that there is lost time and labor required when the magazine is depleted. This is particularly the case when an operator may not immediately recognize that the magazine is depleted.

Accordingly, there is a need for a more efficient supply and delivery system for seals. Desirably, such a system reduces or eliminated the need for replenishing seals in a strapping tool. More desirably still such a supply and delivery system provides a large quantity or available seals in a readily replenishable and usable form.

BRIEF SUMMARY

A strip of multiple, substantially identical seals, each seal for sealing around overlying courses of strapping material to form a seal of the strapping material onto itself at the overlying courses is provided. The strip includes an elongated strip of ductile or malleable metal, such as mild steel, the material preferably having a hardness of about 60 to 75 on a Rockwell C scale.

The strip has a longitudinal direction having edges and defining a longitudinal axis parallel to the edges. A transverse direction is normal to the longitudinal axis. Each seal defines a respective transverse axis. The strip has a plurality of substantially identical slots formed in the transverse direction that define the respective seals. The slots extend toward but not to the edges of the strip and define connecting portions between ends of the slot and the respective edges. The slots are equally spaced from one another in a longitudinal direction to define the respective seals.

One present strip has parallel, longitudinally extending fold lines crossing the slots, inward of the respective edges. The fold lines are formed in the strip, equally spaced from the longitudinal axis.

The strip can also include slits formed in the seals. The slits extend in the transverse direction across the fold lines and toward, but not to the edges. An embodiment of the seal includes at least two pairs of slits, each of the slits of a pair of slits being disposed along a common transverse line and symmetrically disposed relative to the longitudinal axis of the strip. The pairs of slits are symmetrical relative to one another. A presently preferred seal includes four pairs of slits.

The seals can include a locating element formed in each seal. The locating element can be formed as an opening formed along the longitudinal axis and the transverse axis of each seal. The locating opening is used to properly locate the seal within, for example, an automatic or automated strapping machine.

The connectors between seals are formed having a width that is less than about 10 percent of the width of the seal, and preferably about 7 percent to 8 percent of the width of the seal.

These and other features and advantages of the present disclosure will be apparent from the following detailed description, in conjunction with the appended claims.

DETAILED DESCRIPTION OF THE INVENTION

Figure 1A:
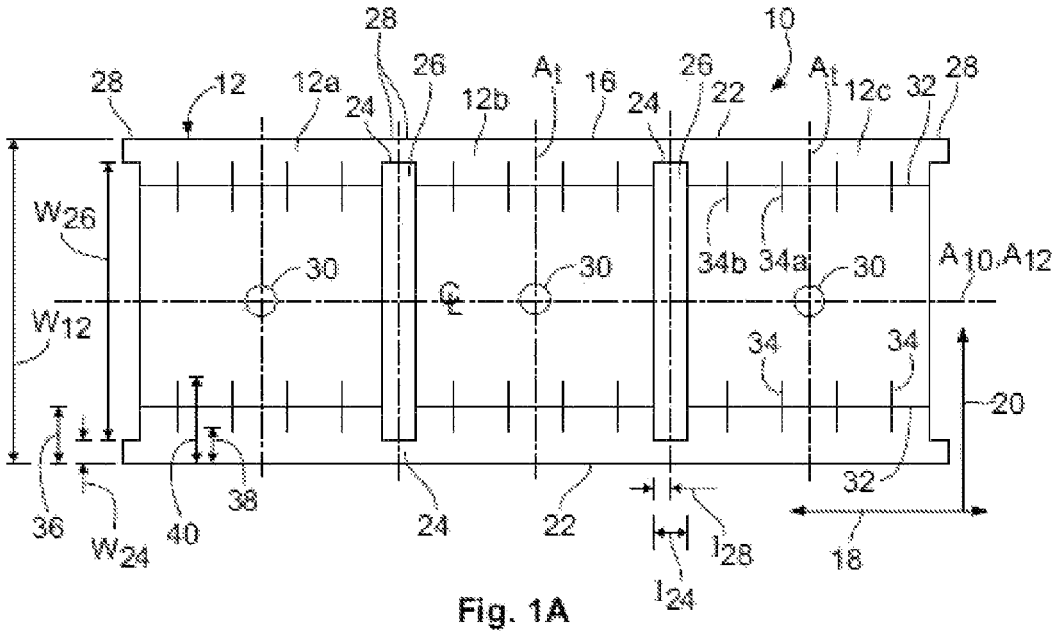
FIG. 1A is plan view of a section of continuous steel strapping seals.

While the present disclosure is susceptible of embodiment in various forms, there are shown in the drawings and will hereinafter be described several embodiments with the understanding that the present disclosure is to be considered an exemplification of the device and is not intended to be limited to the specific embodiments illustrated.

Figure 1B:
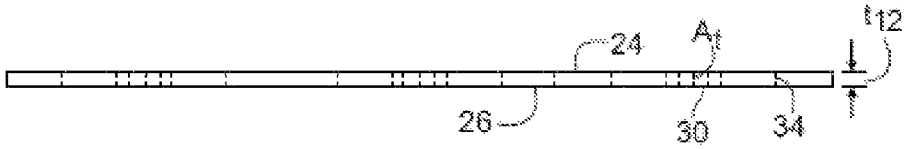
FIG. 1B is a side view of the section of strap seals.

Referring to the figures and in particular to FIG. 1, there is shown a section of a continuous strip 10 of strapping seals 12. The illustrated strip 10 section includes three seals 12*a-c*, but it will be appreciated by those skilled in the art that the section is merely representative of the continuous strip 10, which can be provided in roll form 14, one such roll being shown in FIG. 3. When unwound or laid flat, the seals 12 form the elongated strip 10.

The seals 12 each include a body portion 16 formed essentially symmetrically about a longitudinal axis $A_{10}$ defined by the strip 10. The axis $A_{12}$ of each seal 12 is coaxial with the strip axis $A_{10}$ and the axes of others of the seals 12 on the strip 10. The strip 10 defines a longitudinal direction, as indicated at 18, along the longitudinal axis $A_{10}$ of the strip 10 and a transverse direction, as indicated at 20, transverse to the longitudinal direction 18.

The lateral edges 22 of each seal 12 include connecting portions 24 that connect each seal, for example, seal 12*b*, with its adjacent seals, for example, seals 12*a* and 12*c*. The end seals 12*a*, 12*c*, that is, the seals at the end of the strip 10, include a connecting portion 24 with only one adjacent seal.

Figure 2:
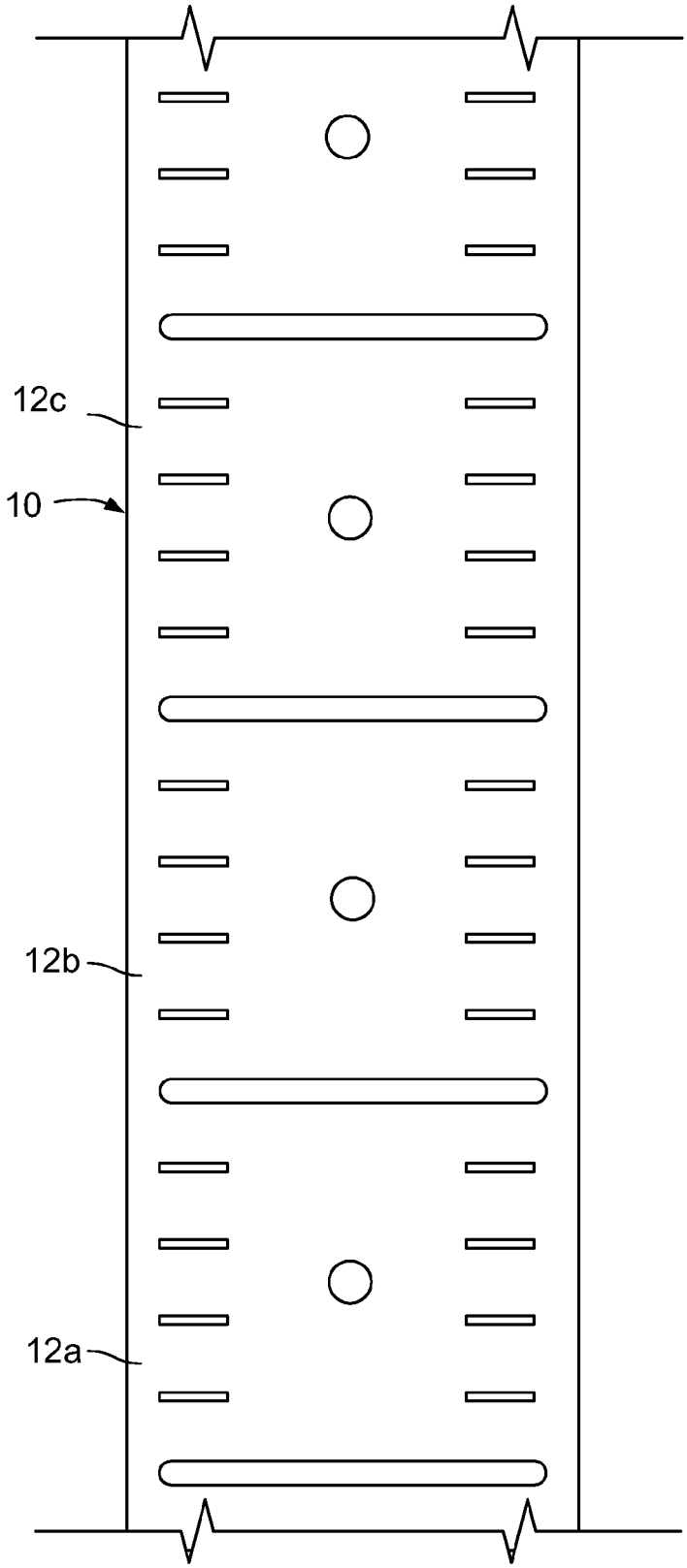
FIG. 2 is a plan view of a longer section of the strapping seals.
Figure 3:
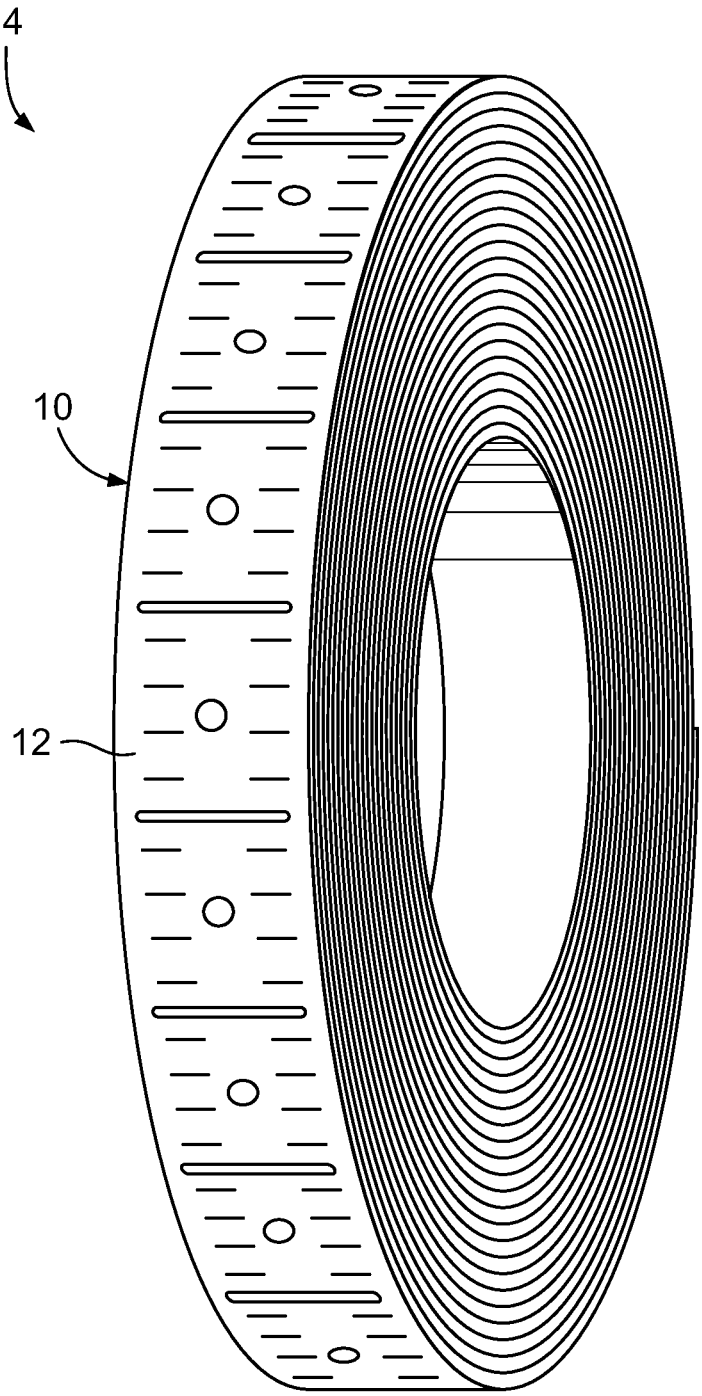
FIG. 3 illustrates the continuous strapping seals formed in a roll.

The connection portions 24 are defined by lateral or transverse slots 26 formed in the strip 10, between the seals 12. The slots 26 can be formed having squared or angled ends as seen in FIG. 1 or with rounded ends as seen in FIGS. 2 and 3. The slots 26 extend toward the lateral edges 22, but do not extend fully to the edges 22 so as to form the connecting portions 24.

The connecting portions 24, on either side of the slot 26, form tabs 28 at the ends of each seal 12.

A central opening or hole 30 is formed in each seal 12. The holes 30 are present to permit the use of a centering or locating device, such as a pin (not shown), to properly locate the seal 12 within the strapping machine (also not shown). In the illustrated embodiment, the central opening 30 is about 0.20 inches.

The seals 12 can be formed with slight indents or fold lines 32 that extend longitudinally along the strip 10, inwardly of the edges 22. The fold lines 32 facilitate forming or folding the seal 12 around the strap 10. The fold lines 32 are formed in the strip 10 to intersect the slots 26.

The seals 12 can also be formed with slits 34 formed in the seals 12. The slits 34 are formed in the transverse direction 20 on either side of the longitudinal axis $A_{12}$ and extend across the longitudinal fold lines 32 inwardly of the edges 22. The slits 34 do not, however, extend out to the edges 22. The slits 34 are provided to facilitate notching the seals 12 (where the seals 12 bite into the strap), to reduce the effort required by the sealing tool and wear on the tool, and to improve joint efficiency (again, by biting into the strap). Those skilled in the art will recognize the seal configuration when sealed on the overlying courses of strap material. By remaining within the confines of the body 16 of the seal 12, the slits 34 do not adversely affect the strength or integrity of the seal 12.

Present continuous strap seals 12 are formed from a malleable or ductile material that can be bent or deformed to form the seal without loosing strength. One such material is steel, such as a mild steel, the material having a hardness of about 60-75 measured on a Rockwell C scale. When flat, the seal 12 has a width $w_{12}$ of about 2.40 inches and a thickness $t_{12}$ of about 0.042 inches (42 mils). The connecting portions 24 each have a width $w_{24}$ of about 0.1875, which corresponds to a slot width $w_{26}$ (dimension in the transverse direction 20) of about 2.025 inches. The connecting portions 24 have a length $l_{24}$ (dimension in the longitudinal direction 18) of about 0.080 inches, such that each tab 28 has a length $l_{28}$ of ½ of the connecting portion length $l_{24}$ or about 0.040 inches. Each seal 12 has an overall length $l_{12}$ of about 2.080 inches, including its tabs 28.

The fold lines 32 are formed inward of the edges 22 about 0.50 inches as indicated at 36. Four sets of slits 34 are cut into the seals 12 extending across their respective fold lines 32. The slits 34 are formed on either side of a central transverse axis $A_t$ about 0.535 inches apart, with slits 34*b* formed at about 0.469 inches outwardly from the inner slits 34*a*. The slits 34 extend inwardly of the seal 12 from edge 22 about 0.25 inches as indicated 38 for a distance of about 0.50 inches as indicated at 40.

The connecting portions 24 are defined by a continuity in the strip 10 at about the edges 22 that extends inward from the edges 22, as indicated at $w_{24}$, about 0.0938 (about 3/32) inches.

In use, as the strip 10 is fed into a strapping machine, the seal 12*c* is located on the strap and is separated or severed from its adjacent seal 12*b* on the strip 10 at their shared connectors 22. The separated seal 12*c* is formed around the strap and notched onto the strap by teeth or notchers that contact the seal 12 at about the slits 34 to urge the seal 12, at the slit 34 edges into contact with the strap.

Those skilled in the art will also recognize the various configurations of the seal 12 that can be made for use in a wide variety of strapping machines, such seals 12 being other than that described above. Such other seal 12 configurations are within the scope and spirit of the present disclosure.

In the present disclosure, the words "a" or "an" are to be taken to include both the singular and the plural. Conversely, any reference to plural items shall, where appropriate, include the singular. All patents referred to herein, are hereby incorporated herein by reference, whether or not specifically done so within the text of this disclosure.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A strip of multiple, substantially identical seals, each seal for sealing around overlying courses of strapping material to form a seal of the strapping material onto itself at the overlying courses, comprising: an elongated strip of ductile metal, the strip having a longitudinal direction having edges and defining a longitudinal axis parallel to the edges and a transverse direction normal to the longitudinal axis, the edges defining a constant width of the strip in the transverse direction along a length of the strip, each seal defining a respective transverse axis, the strip having a plurality of substantially identical slots formed in the transverse direction defining respective seals, the slots extending toward but not to the edges of the strip and defining connecting portions between ends of the slot and the respective edges, the slots being equally spaced from one another in a longitudinal direction to define the respective seals;

wherein the strip has parallel longitudinally extending fold lines crossing the slots, inward of the respective edges.

2. The strip of seals of claim 1 wherein the fold lines are formed in the strip, equally spaced from the longitudinal axis.

3. The strip of seals of claim 1 including a locating element formed in each seal.

4. The strip of seals of claim 3 wherein the locating element is an opening formed in each seal along the longitudinal axis and the transverse axis of each seal.

5. The strip of seals of claim 1 wherein each seal has a length in the longitudinal direction of about 2 inches and a width in the transverse direction of about 2.4 inches.

6. The strip of seals of claim 1 wherein each of the connectors has a width that is less than about 10 percent of the width of the seal.

7. The strip of seals of claim 6 wherein each connector has a width that is about 7 percent to 8 percent of the width of the seal.

8. A strip of multiple, substantially identical seals, each seal for sealing around overlying courses of strapping material to form a seal of the strapping material onto itself at the overlying courses, comprising:

an elongated strip of ductile metal, the strip having a longitudinal direction having edges and defining a longitudinal axis parallel to the edges and a transverse direction normal to the longitudinal axis, each seal defining a respective transverse axis, the strip having a plurality of substantially identical slots formed in the transverse direction defining respective seals, the slots extending toward but not to the edges of the strip and defining connecting portions between ends of the slot and the respective edges, the slots being equally spaced from one another in a longitudinal direction to define the respective seals, wherein the strip has parallel, longitudinally extending fold lines crossing the slots, inward of the respective edges, and slits cut into the seals, the slits extending in the transverse direction across the fold lines and toward, but not to the edges.

9. The strip of seals of claim 8 including at least two pairs of slits, each of the slits of a pair of slits being disposed along a common transverse line and substantially symmetrically disposed relative to the longitudinal axis of the strip.

10. The strip of seals of claim 9 wherein each of the pairs of slits are substantially symmetrical relative to one another.

11. The strip of seals of claim 10 including four pairs of slits.

* * * * *